US008240488B2

(12) United States Patent
Huang

(10) Patent No.: US 8,240,488 B2
(45) Date of Patent: Aug. 14, 2012

(54) BEARING DEVICE

(75) Inventor: Lei Huang, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 399 days.

(21) Appl. No.: 12/567,922

(22) Filed: Sep. 28, 2009

(65) Prior Publication Data

US 2010/0327130 A1 Dec. 30, 2010

(30) Foreign Application Priority Data

Jun. 29, 2009 (CN) ..... 2009 1 0303819

(51) Int. Cl.
*A47F 5/08* (2006.01)

(52) U.S. Cl. ..... 211/107

(58) Field of Classification Search ..... 211/107, 211/196, 205, 133.4, 197, 163; 108/147.1; 248/165; 28/165
See application file for complete search history.

(56) References Cited

U.S. PATENT DOCUMENTS

| | | | | | |
|---|---|---|---|---|---|
| 179,610 | A | * | 7/1876 | Robinson | 211/171 |
| 445,633 | A | * | 2/1891 | Becker | 248/165 |
| 896,990 | A | * | 8/1908 | Hill | 248/125.3 |
| 904,758 | A | * | 11/1908 | Cropp | 211/196 |
| 1,038,198 | A | * | 9/1912 | Randall et al. | 211/205 |
| 1,073,763 | A | * | 9/1913 | Kalitzky | 211/196 |
| 1,107,075 | A | * | 8/1914 | Karges | 403/63 |
| 1,266,749 | A | * | 5/1918 | Abbott | 211/205 |
| 1,292,931 | A | * | 1/1919 | Van Etten | 211/196 |
| 2,309,190 | A | * | 1/1943 | Heller | 211/132.1 |
| 2,692,689 | A | * | 10/1954 | Wynne, Sr. | 211/165 |
| 3,197,034 | A | * | 7/1965 | Deadrick | 211/205 |
| 3,310,180 | A | * | 3/1967 | Neagle | 211/205 |
| 3,414,133 | A | * | 12/1968 | Guerri et al. | 211/107 |
| 3,648,892 | A | * | 3/1972 | Morgan | 221/301 |
| 3,846,213 | A | * | 11/1974 | Thiemann | 428/9 |
| 5,054,622 | A | * | 10/1991 | Lee | 211/2 |
| 5,318,175 | A | * | 6/1994 | Stevens | 211/107 |
| 5,318,189 | A | * | 6/1994 | Lee | 211/205 |
| 5,458,249 | A | * | 10/1995 | Shang-Lu | 211/197 |
| 5,746,334 | A | * | 5/1998 | Brandenberg | 211/205 |
| 5,906,284 | A | * | 5/1999 | Hammerstrom et al. | 211/205 |
| 6,216,887 | B1 | * | 4/2001 | Soo | 211/85.7 |
| 6,318,572 | B1 | * | 11/2001 | Lai | 211/196 |
| 6,568,546 | B1 | * | 5/2003 | Huang | 211/205 |
| 6,702,129 | B1 | * | 3/2004 | Harris | 211/196 |
| 6,708,832 | B1 | * | 3/2004 | Hannon | 211/107 |
| 7,458,475 | B2 | * | 12/2008 | Ho | 211/85.23 |
| 7,475,859 | B2 | * | 1/2009 | Selders | 248/304 |
| 8,051,994 | B2 | * | 11/2011 | Jin et al. | 211/163 |

FOREIGN PATENT DOCUMENTS

| | | |
|---|---|---|
| CN | 2855554 Y | 1/2007 |
| CN | 101007298 A | 8/2007 |

* cited by examiner

*Primary Examiner* — Sarah Purol
(74) *Attorney, Agent, or Firm* — Altis Law Group, Inc.

(57) ABSTRACT

A bearing device comprises a plurality of bearing members and a plurality of connecting members. The length of at least one connecting member having a different length from other connecting members. The connecting members connect the bearing members together, thus adjusting distance between adjacent bearing members by varying the length of the connecting members.

14 Claims, 3 Drawing Sheets

BEARING DEVICE

BACKGROUND

1. Technical Field

The present disclosure relates to bearing devices and, particularly, to a bearing device used in surface treatment techniques.

2. Description of Related Art

With the development of technology, appearance of portable electronic devices e.g., mobile phones and notebooks has been greatly improved. Painting is an effective method to improve the appearance.

Usually, a plurality of portable electronic devices are fixed on a bearing device firstly, and then painted completely using sprays. A typical bearing device includes a plurality of bearing members. Each bearing member is used to bear a plurality of portable electronic devices. The bearing members are connected to each other. A distance between adjacent bearing members is slightly bigger than a size of one portable electronic device, thus avoiding interference between the portable electronic device and adjacent bearing members.

However, the distance between adjacent bearing members cannot be adjusted according to the size of the portable electronic device, thus limiting the amount of portable electronic devices to be fixed thereon, and influencing painting efficiency.

Therefore, there is room for improvement within the art.

BRIEF DESCRIPTION OF THE DRAWINGS

Many aspects of an bearing device can be better understood with reference to the following drawings. These drawings are not necessarily drawn to scale, the emphasis instead being placed upon clearly illustrating the principles of the present bearing device. Moreover, in the drawings like reference numerals designate corresponding sections throughout the several views.

DETAILED DESCRIPTION

The present bearing device is suitable for fixing a workpiece, e.g., mobile phone and notebook thereon in painting.

Figure 1:
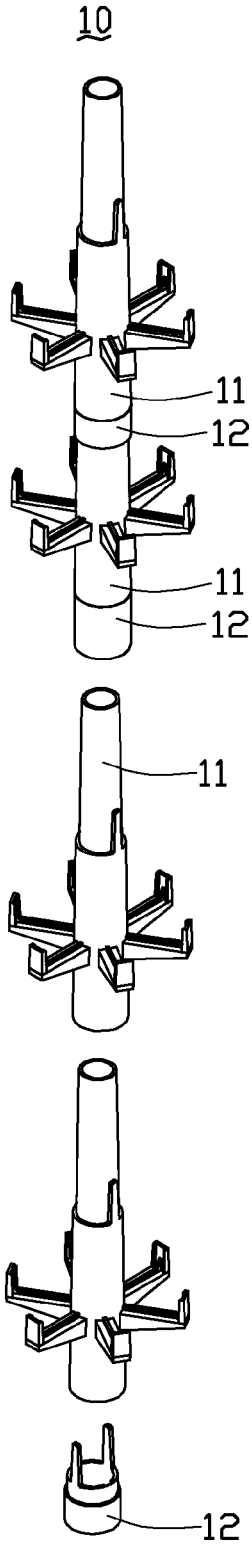
FIG. 1 is an isometric, exploded view of a bearing device, in accordance with an exemplary embodiment.

FIG. 1 shows an exemplary bearing device 10. The bearing device 10 includes a plurality of bearing members 11 and connecting members 12. The connecting members 12 are used to connect the bearing members 11 together.

Figure 3:
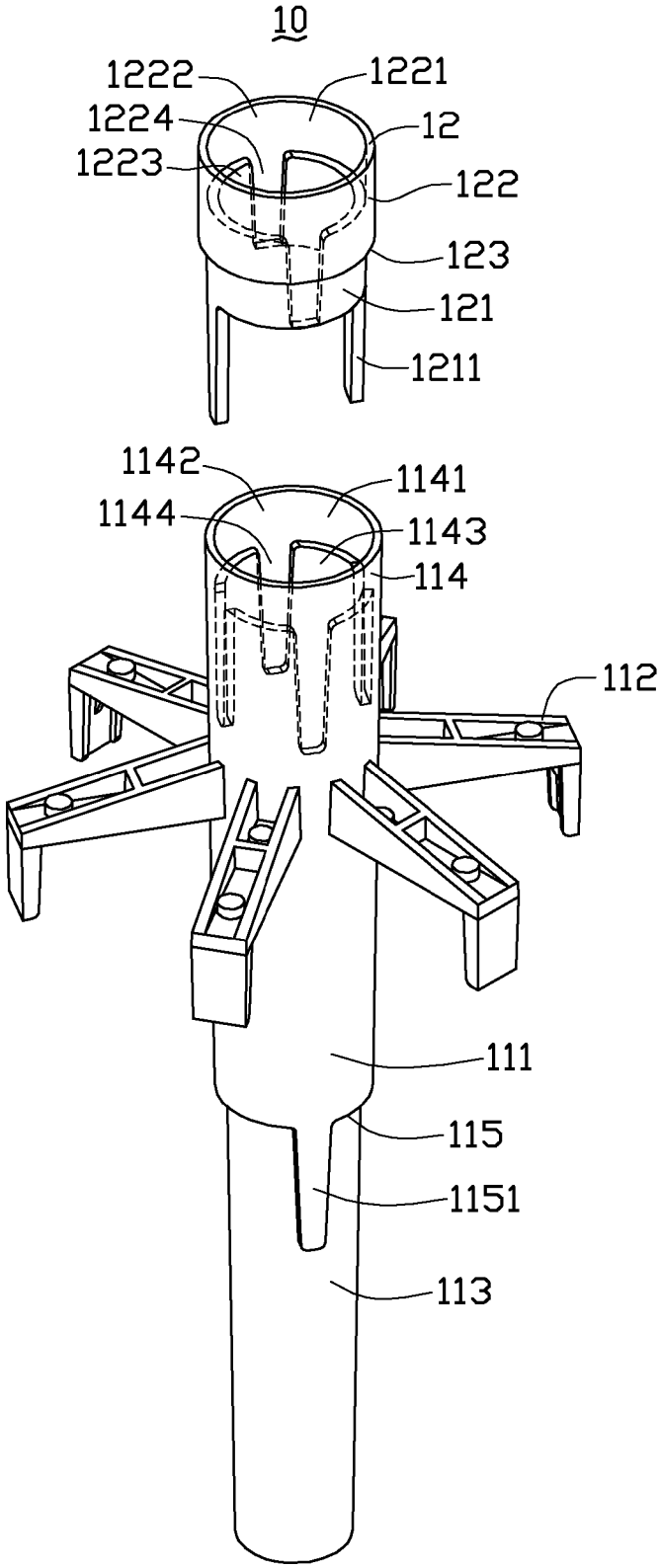
FIG. 3 is an isometric view of a bearing member and a connecting member shown in FIG. 2.

Referring to FIG. 3, each bearing member 11 includes a pole 111 and a plurality of bearing flakes 112. The bearing flakes 112 equally and spacedly protrude from a peripheral wall of the pole 111. In this embodiment, the bearing flake 112 is "L"-shaped, used to bear one portable electronic device thereon. The pole 111 includes a first connecting end 113 and a second connecting end 114 opposite to the first connecting end 113. The first connecting end 113 is a pole, the second connecting end 114 is a hollow pole. The diameter of the second connecting end 14 is larger than that of the first connecting end 13. The first connecting end 113 and the second connecting end 114 connect each other, thus forming a resisting wall 115. The resisting wall 115 faces the first connecting end 113. The resisting wall 115 includes two latching blocks

1151 symmetrically protruding therefrom. In this embodiment, the latching block 1151 is a rod. The second connecting end 114 defines a first latching slot 1141 with an interior peripheral wall 1142. The interior peripheral wall 1142 includes four clamping blocks 1143, forming a second latching slot 1144 between every two adjacent clamping blocks 1143. In this embodiment, the pole 111 are becoming smaller and smaller in diameter from the second connecting end 114 to the first connecting end 113, thus making the bearing members 11 connect each other in phase.

The connecting members 12 is generally a pole, and includes a male connecting end 121 and a female connecting end 122. A diameter of the male connecting end 121 is smaller than the diameter of the female connecting end 122, forming a ladder wall 123 therebetween. The male connecting end 121 includes two male connecting blocks 1211 symmetrically protruding therefrom. In this embodiment, the male connecting block 1211 is a rod. The female connecting end 122 is a hollow body, and defines a female connecting groove 1221 with an interior peripheral wall 1222. The interior peripheral wall 1222 includes two protrusions 1223 symmetrically protruding therefrom, forming two clamping slots 1224 therebetween. The connecting members 12 can be provided in different lengths. Therefore, when using connecting members 12 with different lengths to connect two bearing members 11, a distance between these two bearing members 11 can be changed.

Figure 2:
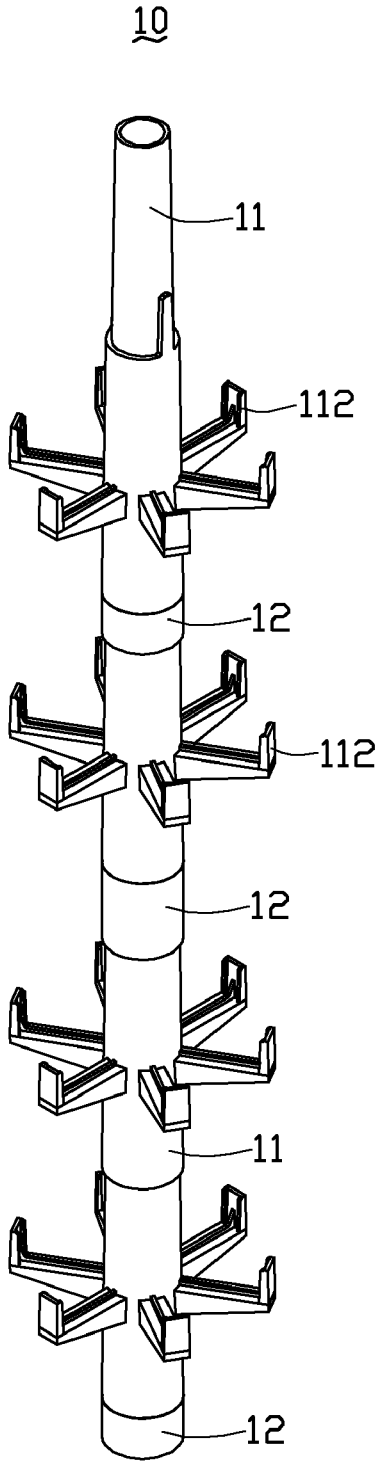
FIG. 2 is an isometric, assembled view of the bearing device shown in FIG. 1.

Referring to FIG. 2, to connect these bearing members 11, the first connecting end 113 of a bearing member 11 is connected to the second connecting end 114 of another bearing member 11, such that two latching blocks 1151 latch into two of the four second latching slots 1144. In this way, the bearing members 11 can be connected together in sequence.

To adjust the distance between adjacent bearing members 11, the connecting members 12 can be placed between every two bearing members 11. For example, A male connecting end 121 of a connecting member 12 is inserted into a second connecting end 114 of a bearing member 11, until the two male connecting blocks 1211 of the male connecting end 121 are latched into two of the four second latching slots 1144 of the second connecting end 114. Then the female connecting end 122 of the same connecting member 12 is connected to a first connecting end 113 of another bearing member 11, until the latching blocks 1151 of the first connecting end 113 are latched into two clamping slots 1224 of the female connecting end 122. At this time, the ladder wall 123 resists the second connecting end 114, and the resisting wall 115 resists the female connecting end 122.

It is to be understood, the number of male connecting blocks 1211 of each connecting member 12 can be four. The number of the latching blocks 1151 can also be four.

The bearing device 10 can adjust the distance between adjacent bearing members 11 by changing one connecting member 12 for another one with a different length, thus bearing the most portable electronic devices at one time of painting, and improving painting efficiency.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of sections within the principles of the disclosure to the full extent indicated by the broad general meaning of the terms, in which the appended claims are expressed.

What is claimed is:

1. A bearing device comprising:

a plurality of bearing members; and a plurality of connecting members, at least one connecting member having a different length from other connecting members, the connecting members connecting the bearing members together, thus adjusting the distance between adjacent bearing members by varying the length of the connecting members;

wherein each bearing member includes a pole including a first connecting end and a second connecting end, the first connecting end has at least one latching block, the second connecting end defines at least one second latching slot; each connecting member includes a male connecting end and a female connecting end, the male connecting end has at least one male connecting block latched with said at least one second latching slot, the female connecting end defines at least one clamping slot, in which said at least one latching block is latched.

2. The bearing device as claimed in claim 1, wherein each bearing member includes a plurality of bearing flakes, the bearing flakes equably and spacedly protruding from a peripheral wall of the pole, the bearing flakes for supporting portable electronic devices thereon.

3. The bearing device as claimed in claim 2, wherein the bearing flake is an "L"-shaped slice.

4. The bearing device as claimed in claim 2, wherein the first connecting end and the second connecting end connect each other, thus forming a resisting wall, the resisting wall faces the first connecting end.

5. The bearing device as claimed in claim 4, wherein there is two said latching blocks symmetrically protruding from the resisting wall, the second connecting end defines a first latching slot with an interior peripheral wall, the interior peripheral wall includes four clamping blocks, forming a said second latching slot between every two adjacent clamping blocks.

6. The bearing device as claimed in claim 5, wherein a diameter of the male connecting end is smaller than the diameter of the female connecting end, forming a ladder wall therebetween, the ladder wall resists the second connecting end, the resisting wall resists the female connecting end.

7. The bearing device as claimed in claim 6, wherein there is two said male connecting blocks symmetrically protruding from the male connecting end, the male connecting blocks latch in the second latching slots, the female connecting end defines a female connecting groove with an interior peripheral wall, the interior peripheral wall includes two protrusions symmetrically protruding therefrom, forming two said clamping slots therebetween, the latching blocks latch in the clamping slots.

8. The bearing device as claimed in claim 1, wherein the poles decrease in diameter from one end to the other end.

9. A bearing device comprising:

a plurality of bearing members; and a plurality of connecting members, at least one connecting member having a different length from other connecting members, the connecting members connecting the bearing members together, thus the distances between adjacent bearing members can be different;

wherein each bearing member includes a pole, the pole includes a first connecting end and a second connecting end opposite to the first connecting end, the first connecting end and the second connecting end connect each other, thus forming a resisting wall, the resisting wall faces the first connecting end; the resisting wall includes two latching blocks symmetrically protruding therefrom, the second connecting end defines a first latching slot with an interior peripheral wall, the interior peripheral wall includes four clamping blocks, forming a second latching slot between every two adjacent clamping blocks, the latching blocks are inserted into the second latching slots.

10. The bearing device as claimed in claim 9, wherein each bearing member includes a plurality of bearing flakes, the bearing flakes equably and spacedly protruding from a peripheral wall of the pole, the bearing flakes for supporting portable electronic devices thereon.

11. The bearing device as claimed in claim 10, wherein the bearing flake is an "L"-shaped slice.

12. The bearing device as claimed in claim 9, wherein the connecting members includes a male connecting end and a female connecting end, a diameter of the male connecting end is smaller than the diameter of the female connecting end, forming a ladder wall therebetween, the ladder wall resists the second connecting end, the resisting wall resists the female connecting end.

13. The bearing device as claimed in claim 12, wherein the male connecting end includes two male connecting blocks symmetrically protruding therefrom, the male connecting blocks latch in the second latching slots, the female connecting end defines a female connecting groove with an interior peripheral wall, the interior peripheral wall includes two protrusions symmetrically protruding therefrom, forming two clamping slots therebetween, the latching blocks latch in the clamping slots.

14. The bearing device as claimed in claim 9, wherein the poles decrease in diameter from one end to the other end.

* * * * *